United States Patent [19]

Bar-on

[11] 3,940,238

[45] Feb. 24, 1976

[54] CLEANING STRUCTURE FOR AN ELASTOMERIC FUSER MEMBER

[75] Inventor: Ari Bar-on, Rochester, N.Y.

[73] Assignee: Xerox Corporation, Stamford, Conn.

[22] Filed: June 24, 1974

[21] Appl. No.: 482,731

[52] U.S. Cl. ..... 432/75; 432/60; 432/228; 15/256.51; 15/1.5

[51] Int. Cl.[2] ..... F27D 23/00

[58] Field of Search ..... 432/75, 59, 60, 227, 228, 432/8; 219/216, 388, 469; 100/93 RP; 15/1.5, 1.7, 256.52, 236 R, 236 A, 256.51

[56] References Cited

UNITED STATES PATENTS

| | | | |
|---|---|---|---|
| 2,323,907 | 7/1943 | Harriss et al. | 15/256.51 |
| 3,156,953 | 11/1964 | Newton et al. | 15/256.51 |
| 3,178,774 | 4/1965 | Pippin, Jr. et al. | 15/256.51 |
| 3,649,992 | 3/1972 | Thettu | 432/75 |
| 3,672,764 | 6/1972 | Hartwig et al. | 15/256.51 |
| 3,728,016 | 4/1973 | Harbour, Jr. et al. | 15/1.5 |
| 3,742,551 | 7/1973 | Oriel | 15/256.51 |
| 3,811,821 | 5/1974 | Ariyama et al. | 432/60 |

*Primary Examiner*—John J. Camby
*Assistant Examiner*—Henry C. Yuen

[57] ABSTRACT

Contact fusing system for utilization in the process of forming toner images on support sheets. The system is characterized by the provision of structure for cleaning toner material from an elastomeric backup member cooperating with a heated fuser member to move support sheets bearing the toner images therebetween with the toner images contacting the heated member. The cleaning structure comprises a sleeve of tetrafluoroethylene which is heat shrunk onto an angular-shaped support member whereby approximately one-third of the sleeve forms a cleaning surface which is contacted intermediate the ends thereof by the elastomeric backup member.

4 Claims, 10 Drawing Figures

CLEANING STRUCTURE FOR AN ELASTOMERIC FUSER MEMBER

BACKGROUND OF THE INVENTION

This invention relates generally to xerographic copying apparatus and, more particularly, to a contact fusing system for fixing electroscopic toner material to a support member.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual image can be either fixed directly upon the photosensitive member or transferred from the member to a sheet of plain paper with subsequent affixing of the image thereto.

In order to permanently affix or fuse electroscopic toner material onto a support member by heat, it is necessary to elevate the temperature of the toner material to a point at which the constituents of the toner material coalesce and become tacky. This action causes the toner to be absorbed to some extent into the fibers of the support member which, in many instances, constitutes plain paper. Thereafter, as the toner material cools, solidification of the toner material occurs causing the toner material to be firmly bonded to the support member. In both the xerographic as well as the electrographic recording arts, the use of thermal energy for fixing toner images onto a support member is old and well known.

One approach to thermal fusing of electroscopic toner images onto a support has been to pass the support with the toner images thereon between a pair of opposed roller members, at least one of which is internally heated. During operation of a fusing system of this type, the support member to which the toner images are electrostatically adhered is moved through the nip formed between the rolls with the toner image contacting the fuser roll to thereby effect heating of the toner images within the nip. By controlling the heat transferred to the toner, virtually no offset of the toner particles from the copy sheet to the fuser roll is experienced under normal conditions. This is because the heat applied to the surface of the roller is insufficient to raise the temperature of the surface of the roller above the "hot offset" temperature of the toner whereat the toner particles in the image areas of the toner would liquify and cause a splitting action in the molten toner to thereby result in "hot offset". Splitting occurs when the cohesive forces holding the viscous toner mass together is less than the adhesive forces tending to offset it to a contacting surface such as a fuser roll.

Occasionally, however, toner particles will be offset to the fuser roll by an insufficient application of heat to the surface thereof (i.e. "Cold" offsetting); by imperfections in the properties of the surface of the roll; or by the toner particles insufficiently adhering to the copy sheet by the electrostatic forces which normally hold them there. In such a case, toner particles may be transferred to the surface of the fuser roll with subsequent transfer to the backup roll during periods of time when no copy paper is in the nip.

Moreover, toner particles can be picked up by the fuser and/or backup roll during fusing of duplex copies or simply from the surroundings of the reproducing apparatus.

One arrangement for minimizing the foregoing problems, particularly that which is commonly referred to as "offsetting" has been to provide a fuser roll with an outer surface or covering of polytetrafluoroethylene, commonly known as Teflon, to which a release agent such as silicone oil is applied, the thickness of the Teflon being on the order of several mils and the thickness of the oil being less than 1 micron. Silicone based oils, which possess a relatively low surface energy, have been found to be materials that are suitable for use in the heated fuser roll environment where Teflon constitutes the outer surface of the fuser roll. In practice, a thin layer of silicone oil is applied to the surface of the heated roll to thereby form an interface between the roll surface and the toner images carried on the support material. Thus a low surface energy layer is presented to the toner as it passes through the fuser nip and thereby prevents toner from offsetting to the fuser roll surface. The silicone oil or other suitable release agent is conventionally applied to the fuser roll structure by wick or other suitable means which serves to remove those toner particles whice do find their way onto the fuser roll.

It is also desirable to provide a cleaning structure for the backup roll for removing toner therefrom, particularly, when the fuser is utilized in a duplex mode of operation. In certain prior art fusing devices, the backup roll is provided with a Teflon sleeve which is cleaned by contact with a web, wick or brush without the aid of oil or other release agent being applied thereto. It has been observed that continued operation at elevated temperatures such as exhibited in the fusing environment of a xerographic reproducing apparatus, the life expectancy of material such as Teflon is somewaht curtailed.

Silicone rubbers and other temperature resistant elastomeric materials such as Viton employed for backup roll constructions have been found to better withstand such operating conditions. Viton is a trademark of E. I. duPont de Nemours and Co. which covers a series of fluoroelastomers based on the copolymer of vinylidene fluoride and hexafluoropropylene. However, they do not readily lend themselves to being cleaned by the aforementioned techniques. This is due to a large extent to the relatively high coefficient of friction and asperities in the surface of the elastomeric surface.

Accordingly, it is the principal object of this invention to provide a new and improved copier apparatus.

It is a more particular object of this invention to provide a new and improved contact fuser for fixing toner images to support sheets.

Another object of this invention is to provide a new and improved cleaning system and method of fabrication thereof which cleaning system is utilized in conjunction with an elastomeric fuser member of a system for fixing toner images to support sheets.

BRIEF SUMMARY OF THE INVENTION

Briefly, the above-cited objects are accomplished by the provision of a heat and pressure roll fusing system comprising an elastomeric backup roll forming a nip with a heated fuser roll structure through which copy sheets are moved with toner images carried thereby contacting the heated fuser roll structure. The elastomeric backup roll preferably comprises a material known as Viton which is a trademark of E. I. Dupont. However, the backup roll may comprise a layer of other high temperature elastomeric material such as silicone or fluorosilicone rubber.

A triangular-shaped cleaning member supported on an angular support member is provided for cleaning toner from the backup roll. In the preferred embodiment of the invention, the triangular-shaped member is fabricated from a low surface energy material, for example, tetrafluoroethylene which is molded or otherwise suitably formed into a sleeve which can be heat shrunk onto the angular support.

The triangular cleaning member is disclosed in conjunction with the detailed description of the preferred embodiment, is movably supported on a base member of the fuser assembly by means of a pair of rollers. Spring means are provided for urging the cleaning member into light pressure engagement with the backup roll so as to form a nip therewith which preferably has its exit disposed sub-adjacent its entrance. The cleaning structure is supported such that the rotation of the backup roll tends to move or bias the structure against the roller supports. The base member serves as a catch tray for toner material which accumulates at the exit of the nip formed between the cleaning member and the backup roll and then falls onto the base member. While the preferred mounting of the cleaning structure allows for biasing thereof into engagement with the backup roll it may also be fixedly mounted. It may also be associated with a backup roll which occupies a reverse position to that disclosed relative to the fuser roll structure in which event it would be necessary to provide a toner catch tray rather than allowing the toner to fall onto the aforementioned base plate. In the event that the cleaning member and backup roll structure are so positioned as to have the exit nip disposed above the entrance of the nip, means, for example, suction apparatus could be provided adjacent the exit nip to remove the accumulated toner therefrom.

Other objects and advantages of the present invention will become apparent when read in conjunction with the accompanying drawings wherein.

DETAILED DESCRIPTION OF THE PREFERRED EMBODIMENT

Figure 1:
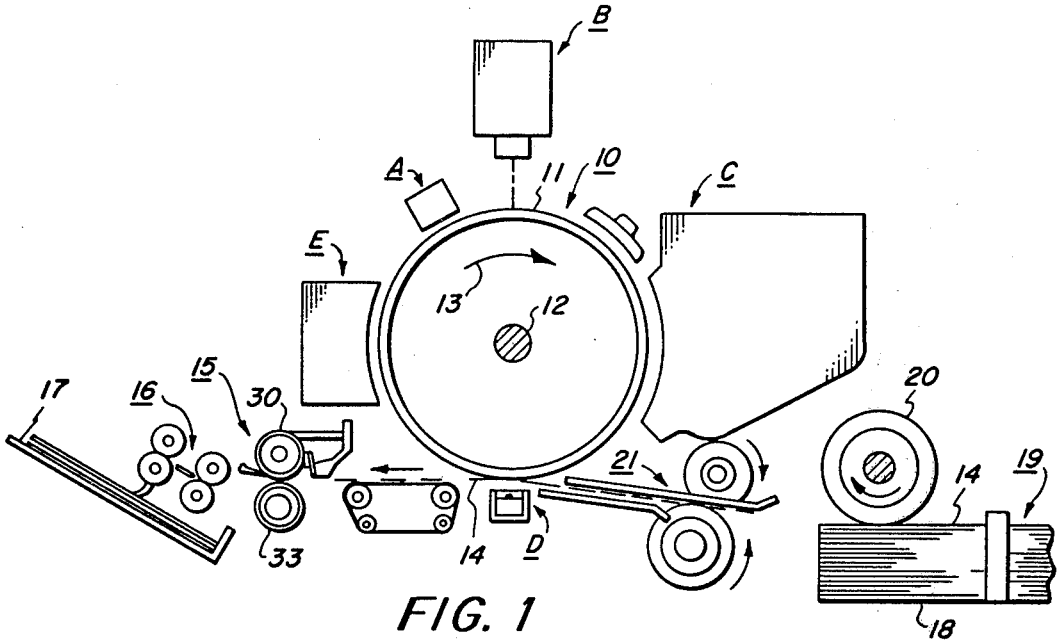
FIG. 1 is a schematic representation of a xerographic reproducing apparatus incorporating the novel image fuser of the present invention.

The reproducing machine illustrated in FIG. 1 employs an image recording drum-like member 10 the outer periphery of which is coated with a suitable photoconductive material 11. One type of photoconductive material is disclosed in U.S. Pat. No. 2,970,906 issued to Bixby in 1961. The drum 10 is suitably journaled for rotation within a machine frame (not shown) by means of a shaft 12 and rotates in the direction indicated by arrow 13, to bring the image retaining surface thereon past a plurality of xerographic processing stations. Suitable drive means (not shown) are provided to power and coordinate the motion of the various cooperating machine components whereby a faithful reproduction of the original input scene information is recorded upon a sheet of final support material such as paper or the like.

Since the practice of xerography is well known in the art, the various processing stations for producing a copy of an original are herein represented in FIG. 1 as blocks A to E. Initially, the drum moves photoconductive surface 11 through a charging station A. At charging station A an electrostatic charge is placed uniformly over the photoconductive surface 11 of the drum 10 preparatory to imaging. The charging may be provided by a corona generating device of a type described in U.S. Pat. No. 2,836,725 issued to Vyverberg in 1958.

Thereafter, the drum 10 is rotated to exposure station B where the charged photoconductive surface 11 is exposed to a light image of the original input scene information, whereby the charge is selectively dissipated in the light exposed regions to record the orginial input scene in the form of a latent electrostatic image. A suitable exposure system may be of the type described in U.S. Patent application, Ser. No. 259,181 filed June 2, 1972.

After exposure, drum 10 rotates the electostatic latent image recorded on the photoconductive surface 11 to development station C, wherein a conventional developer mix is applied to the photoconductive surface 11 of the drum 10 rendering the latent image visible. A suitable development station is disclosed in U.S. Patent application, Ser. No. 199,481 filed Nov. 17, 1971. This application describes a magnetic brush development system utilizing a magnetizable developer mix having carrier granules and toner comprising electrophotographic resin plus colorant from dyes or pigments. A developer mix is continually brought through a directional flux field to form a brush thereof. The electrostatic latent image recorded on photoconductive surface 11 is developed by bringing the brush of developer mix into contact therewith. The developed image on the photoconductive surface 11 is then brought into contact with a sheet of final support material 14 within a transfer station D and the toner image is transferred from the photoconductive surface 11 to the contacting side of the final support sheet 14. The final support material may be plain paper, gummed labels, transparencies such as Polycarbonate, Polysulfane and Mylar, etc., as desired.

After the toner image has been transferred to the sheet of final support material 14, the sheet with the image thereon is advanced to a suitable fuser assembly 15 which fuses the transfer powder image thereto. After the fusing process, the final support material 14 is advanced by a series of rolls 16 to a copy paper tray 17 for subsequent removal therefrom by a machine operator.

Although a preponderence of the toner powder is transferred to the final support material 14, invariably some residual toner remains on the photoconductive surface 11 after the transfer of the toner powder image to the final support material 14. The residual toner particles remaining on the photoconductive surface 11 after the transfer operation are removed from the drum 10 as it moves through cleaning station E. Here the residual toner particles are first brought under the influence of a cleaning corona generating device (not shown) adapted to neutralize the electrostatic charge remaining on the toner particles. The neutralized toner particles are then mechanically cleaned from the photoconductive surface 11 by conventional means as for example, the use of a resiliently biased knife blade as set forth in U.S. Pat. No. 3,660,863 issued to Gerbasi in 1972.

The sheets of final support material 14 processed in the automatic xerographic reproducing device may be stored in the machine within a removable paper cassette 18. A suitable paper cassette is set forth in U.S. Patent application, Ser. No. 208,138 filed Dec. 15, 1971.

The copier can also have the capability of accepting and processing copying sheets of varying lengths. The length of the copy sheet, of course, being dictated by the size of the original input scene information recorded on the photoconductive surface 11. To this end, the paper cassette 18 is preferably provided with an adjustable feature whereby sheets of varying length and width can be conveniently accommodated therein.

In operation, the cassette 18 is filled with the stack of final support material 19 of pre-selected size and the cassette 18 is inserted into the machine by sliding along a baseplate (not shown) which guides the cassette 18 into operable relationship with a pair of feed rollers 20. When properly positioned in communication with the feed rollers 20 the top sheet of the stack 19 is separated and forwarded from the stack 19 into the transfer station D by means of registration rollers 21.

It is believed that the foregoing description is sufficient for purposes of present application to illustrate the general operation of an automatic xerographic copier which can embody the teachings of the present invention.

Figure 2:
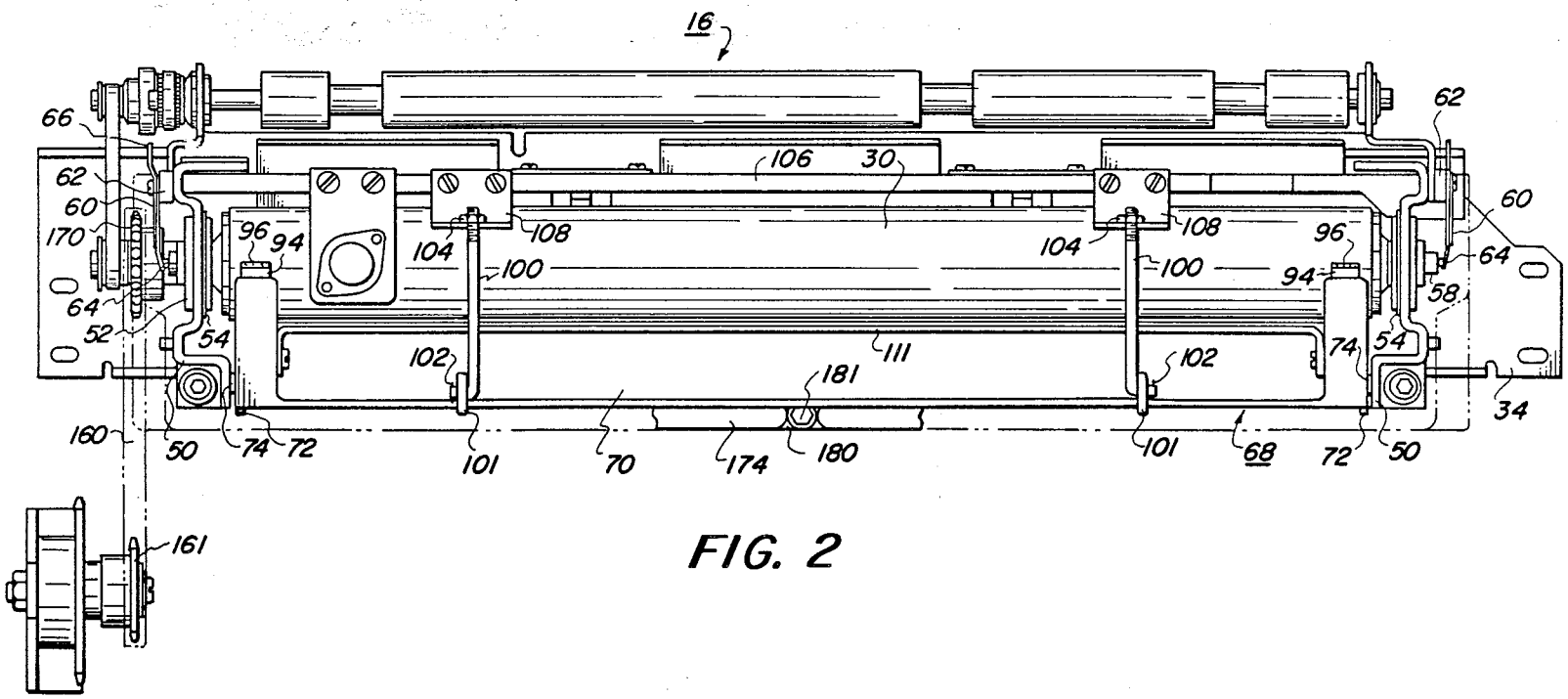
FIG. 2 is a top plan view of a fuser assembly incorporated in FIG. 1.
Figure 3:
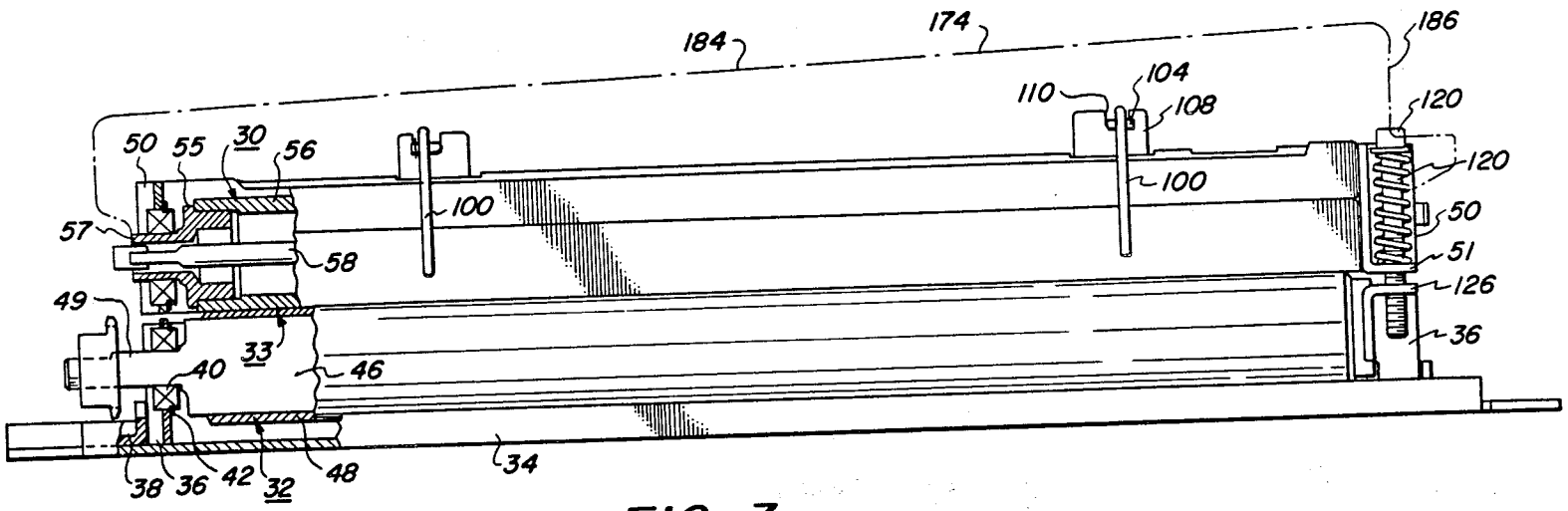
FIG. 3 is a right side elevational view of the fuser assembly of FIG. 2.
Figure 4:
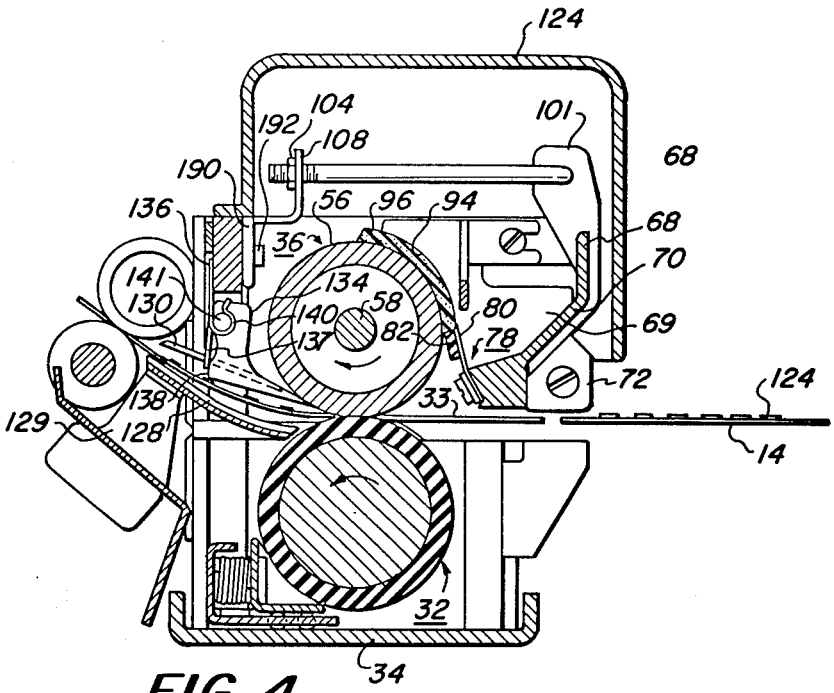
FIG. 4 is a cross-sectional view taken on the line IV—IV of FIG. 3.

The fuser assembly 15 as best illustrated in FIGS. 2 through 4 comprises a heated fuser roll structure 30 and a backup roll 32 which cooperate to form a nip 33 therebetween through which copy paper having toner images thereon passes with the toner images contacting the fuser roll structure 30.

A channel shaped support base 34 (FIG. 3) is provided for supporting the fuser assembly 15 in the copier apparatus. The backup roll 32 is supported by a pair of support brackets 36 which are secured to the support base 34 by means of right angle brackets 38, the base of which are spot welded or otherwise suitably affixed to the support base 34. A pair of ball bearings 40 are supported by the brackets 36 and are captivated in the brackets by means of retaining rings 42. The backup roll structure may comprise any suitable construction, for example, a steel cylinder, but preferably comprises a rigid steel core or shaft 46 having a Viton elastomer surface or layer 48 disposed thereover and affixed thereto. A pair of shaft ends 49 of the core or shaft 46 are received in the bearings 40 for supporting the backup roll 30. A suitable backup roll has an overall dimension of approximately 1.55 inches including a 0.1 inch cover or layer of Viton elastomer or other suitable high temperature elastomeric material, for example, fluorosilicone or silicone rubber. The specific dimensions of the backup roll will be dictated by the requirements of the particular copying apparatus wherein the fuser assembly 15 is employed, the dimensions being greater or less depending upon the process speed of the machine. In this embodiment the length of the roll is approximately 15½ inches to accomodate various paper sizes.

A pair of support brackets 50 (FIG. 2) having a generally E-shaped configuration similar to the support brackets 36 are provided for mounting the fuser roll structure in the fuser assembly 15. To this end, a pair of ball bearings 52 one in each of the support brackets 50 are provided, the bearings being retained in the brackets by means of retaining rings 54. A pair of end caps 55 are secured to a hollow cylinder or core 56 (FIGS. 3 and 4) forming a part of the fuser roll structure 30 and reduced portions 57 thereof are received in the bearings 52 for supporting the fuser roll structure. A heating element 58 is supported internally of the core 56 for providing thermal energy to elevate the temperature of the core to operating limits. The heating element may comprise any suitable type heater for elevating the surface temperature of the cylinder to operational temperatures, therefore 285–290° F. For example, it may be a quartz envelope having a tungsten resistance heating element disposed therein. The cylinder or core 56 is fabricated from any suitable material capable of efficiently conducting the heat to the external surface of the core. Typical materials are anodized aluminum and alloys thereof, steel, stainless steel, nickel and alloys thereof, nickel plated copper, chrome plated copper, copper and alloys thereof. The resulting structure has an outside diameter on the order of 1.5 inches and has a length equal to that of the backup roll. The power requirements for the foregoing are 420 watts peak power with an average power of 320 watts and 100 watts for standby.

The heater element 58 is supported internally of the core 56 by a pair of spring supports 60 which are mounted by insulator blocks 62 to the support brackets 50. The free ends of the springs supporting the heater element are each provided with a locating ball 64 while the opposite end of the spring is disposed in contact with an electrical terminal 66 to which electrical wires (not shown) may be attached for supplying electrical energy to the heater element. The terminal blocks can be secured to the support brackets in any suitable manner, for example, by screws. The springs supports and terminals are preferably rivoted to the terminal block.

The aforementioned materials from which the core 56 of the fuser roll structure may be fabricated are relatively high surface energy materials, consequently, hot toner material contacting such surfaces would readily wet the surface of the fuser roll and it would be difficult to remove the toner therefrom. Accordingly, there is provided a sump 68 (FIGS. 2 and 4) for containing a material 69 capable of interacting with the core in a manner described in U.S. Patent application, Ser. No. 383,231 filed July 27, 1973 in the name of Moser, et al and assigned to the same assignee as the instant application. The material is preferably a low molecular weight substance which is solid at room temperature and which has a relatively low viscosity at the operating temperatures of the fuser roll structure. An example of such a material is polyethylene homopolymer manufactured by Allied Chemical Co. and having the designation AC-8 hopolymer.

Figure 5:
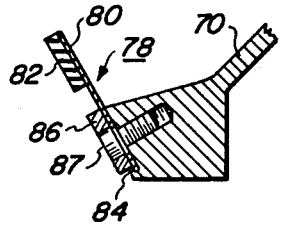
FIG. 5 is an enlarged fragmentary view in section of a release agent doctoring structure forming a part of the fuser assembly of FIGS. 2 thru 4.
Figure 6:
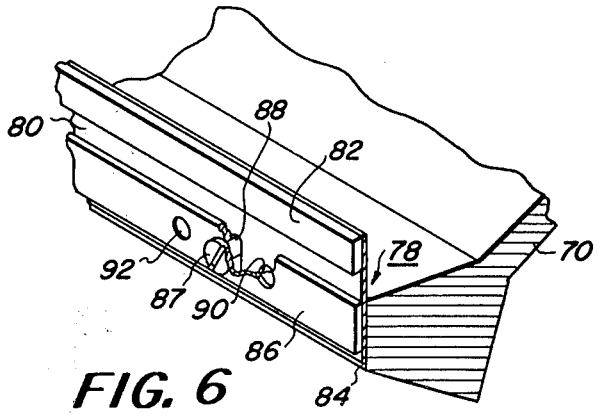
FIG. 6 is a perspective view of the composite doctoring structure of FIG. 5.

The sump 68 comprises a rear wall 70 having a generally sloping portion connected to a generally vertical portion. The rear wall is provided with a pair of apertured flanges 72 for receiving supports 74 for mounting the sump 68 to the flanges 51 secured to the brackets 50 in a manner to allow pivotal movement thereof. The sump also comprises a front wall (FIG. 5) which comprises a composite doctoring blade 78 including a base member 80 with an elongated strip 82 secured to the base member. The strip 82 is fabricated from a high temperature elastomeric material which is compatible with the particular material 69, for example, silicone rubber or Viton. By compatible with the strip it is meant that the dimensions of the strip are not altered by contact with the material.

The base member 80 and therefore the blade 78 is supported by the rear wall 70 by means of a rubber seal attached to a lip 84 forming a part of the rear wall and a retainer 86 which is suitably secured by, for example, screw 87, to the rear wall 70. The base member 80 is provided with a plurality of slots 88 in which the screws 87 ride to allow mounting of the base member intermediate the retainer 86 and the rear wall 70. The base member is also provided with a plurality of apertures 90 disposed on the sides of the slots 88. The apertures receive dimples 92 forming a part of the retainer 86. The slots and the apertures are oversized with respect to the dimples and screws so that the base member can move due to thermal expansion without buckling thereof. It will be appreciated that in addition to serving as a metering blade the composite structure 78 serves to clean toner from the fuser roll structure 30 and also act as a seal to prevent the liquid or low viscosity polyethylene from leaking out of the sump 68. A pair of arcuate recesses 94 provided in the rear wall 70 have disposed therein end seals 96 which contact the fuser roll structure and thereby cooperate with the strip 82 to prevent leakage of polyethylene from the sump.

A pair of links 100 attached to extensions 101 of the rear wall by retaining pins 102 have their ends threaded for receiving nuts 104. A tie bar 106 attached to the support brackets 50 support L-shaped brackets 108 having slots 110 therein. The links 100 are received in the slots 110 to thereby provide means for adjusting the pivotal orientation of the sump 68 to thereby increase or decrease the pressure of the composite doctoring structure 78 on the fuser roll structure to thereby control in accordance with a predetermined amount, for example, a layer less than 1 micron thick, the application of polyethylene to the fuser roll structure. This is accomplished by tightening or loosening of the nuts 104.

As mentioned hereinbefore, the polyethylene is solid at room temperature and is liquid at operational temperatures. The polyethylene in solid form is placed in the sump and is heated by the thermal energy of the fusing roll structure and thereby liquified. When the polyethylene resolidifies after the machine has been inoperative for a period of time the polyethylene tends to move away from the fuser roll structure consequently when the machine is restarted the polyethylene may not be applied to the fuser roll structure immediately. This means that the fuser roll structure may not be properly protected against toner offsetting to the bare metal. In order to safeguard against the foregoing, the surface of the rear wall contacting the polyethylene is coated with a material that has a low affinity for the polyethylene, for example, silicon rubber. in order to insure that the polyethylene is in contact with the fuser roll structure at the time of restarting the machine, a collecting bar 111 is provided in the sump and attached thereto such that it is positioned adjacent the fuser roll structure. Accordingly, when the polyethylene resolidifies it will pull away from the rear wall 70 and it will solidify on the collecting bar such that it is still in contact with the fuser roll structure. This arrangement will insure proper operation of the fuser assembly until the bulk of the polyethylene is melted in the sump.

The axis of the backup roll which should be apparent from a consideration of its mounting as discussed above is fixed relative to the support base 34. However, the fuser roll structure is mounted such that it's pressure engagement with the backup roll can be adjusted to thereby enable variation of the length of the nip 33 formed between the two roll structures. To this end, the fuser roll support brackets 50 are mounted to the backup roll support brackets 36 by a pair of flexures 112 which are secured to the support brackets 36 and 50 by means of retaining plates 114, dowl pins 116 and caps screws 118. The flexures 112 are preferably fabricated from spring steel having a relatively small thickness but sufficiently sturdy to hingedly mount the fuser roll support brackets to the backup roll support brackets. A force at the nip on the order of 150 pounds is provided by means of socket head screws 120 and commercial compression springs 122 which are supported by the upper flanges 51 secured to the fuser roll support brackets 50. The screws 120 are received in threaded lower flanges 126 which are fixedly mounted to the backup roll support brackets 36. It will be appreciated that by adjusting the socket head screws 120 against the force exerted by the springs 122, the nip pressure can be varied to produce the desired nip pressure.

Figure 8:
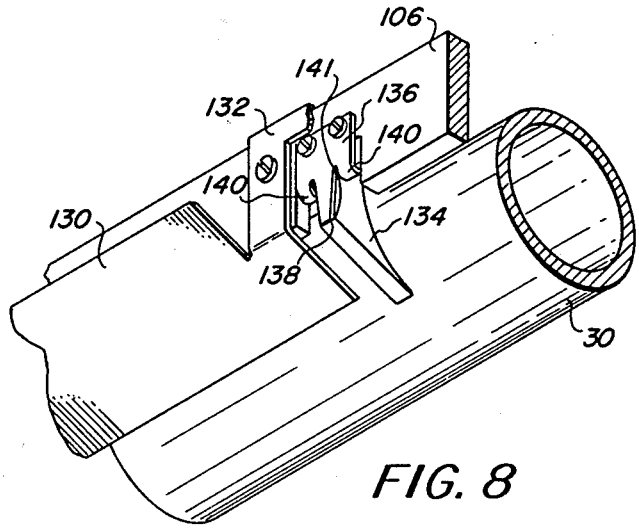
FIG. 8 is a perspective view of a copy sheet stripper finger.

The copy paper 14 carrying the fused images comprising toner 124 is moved through a lower guide plate 128 (FIG. 4) which is supported by mounting brackets 129 attached to the backup roll supporting brackets 36 and an upper guide plate 130 attached to the tie bar 106. The upper guide plate is mounted to the tie bar by means of a generally U-shaped flange 132 having an open area which is integral with the plate 130 and disposed at an acute angle relative thereto. To insure that the copy paper follows along a predetermined path including the space between the lower and upper guide plates a plurality of generally L-shaped stripper fingers 134 (FIGS. 4 and 8), preferably two in number, are provided. The leading edges of the stripper fingers are biased into engagement with the fuser roll structure 30 by means of a pair of combination mounting brackets and bias member 136 in the form of leaf springs. The leaf springs are mounted to the tie bar 106 such that a cantilevered portion 137 thereof engages a cam surface 138 of the stripper finger 134. Portions of the mounting bracket 136 are rolled as indicated at 140 to provide a bearing surface for shafts 141 carried by the stripper fingers 134.

Figure 9:
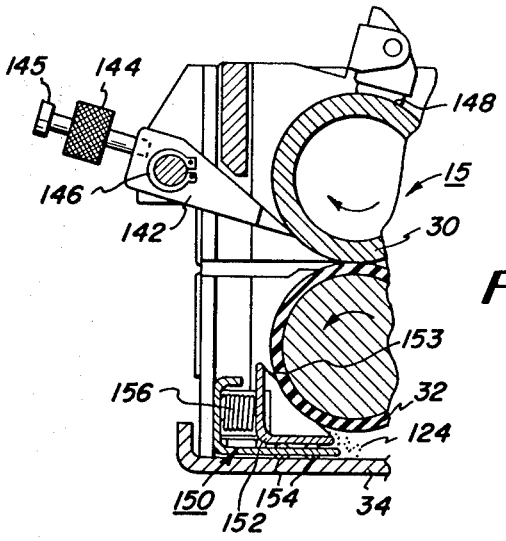
FIG. 9 is a cross-sectional view of a fuser roll system showing a modified stripper finger arrangement and a backup roll cleaning structure.
Figure 10:
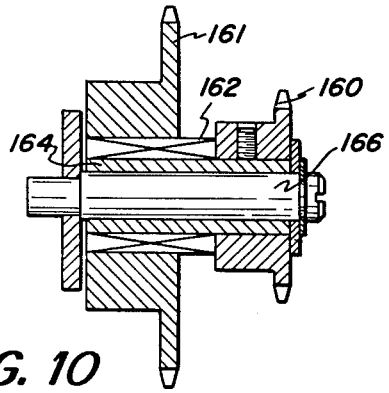
FIG. 10 is a cross-sectional view of a sprocket drive and one-way clutch arrangement incorporated in the fuser assembly.

An alternate form of stripper finger may be employed which comprises stripper fingers 142 (FIG. 9) supported on a shaft 143 which is supported indirectly by the support brackets 50 of the fuser roll structure 30. A counterweight 144 is provided for each of the stripper fingers 142 and is secured thereto by means of a cap screw 145 which is threaded into the stripper finger. The position of the counterweight can be varied relative to the stripper finger to increase or decrease the amount of pressure which is applied by the stripper finger to the fuser roll structure. The position of the stripper fingers 142 are maintained on the shaft in a position relative to the longitudinal axis of the fuser roll structure 30 by grip rings 146. The grip rings while maintaining the position of the stripper fingers fixed relative the fusing roll structure 30 allow movement relative to the aforementioned axis of the stripper fingers with respect to the fuser roll structure so that the fuser stripper fingers can be repositioned in the event of wear of the fuser roll structure.

The surface temperature of the fuser roll structure 30 is controlled by contacting the surface thereof with a thermistor probe 148 of the type described in U.S. Pat. No. 3,327,096, issued in 1967 to Bernous and incorporated herein by reference.

During operation of the fuser assembly 15, particularly during duplex copying, toner accumulates on the backup roll structure 32. Accordingly, a backup roll cleaning structure or assembly 150 is provided which comprises a triangular shaped support member 152 having a wiper member 153 carried thereby. The cleaning assembly is supported for movement in the direction of the backup roll structure by a plurality of roller supports 154 and a spring member 156 supported by a member 158 urges the wiper surface into wiping contact with the backup roll. As can be seen from the drawings, the cleaning assembly is disposed adjacent the support base 34 so that toner removed from the backup roll will be deposited onto the support base. In operation it has been found that the toner accumulates on the exit side of the nip formed between the backup roll and the wiper member. The wiper member is preferably a high temperature material with a high degree of resiliency and low affinity for toner particles and preferably comprises tetrafluoroethylene, commonly referred to as TFE.

In order to accomplish rotational movement of the fuser and backup rolls, the main machine drive is coupled to the backup roll structure via a drive sprocket 160, which is coupled to a driven sprocket 161 by means of a one-way clutch 162, a bushing 164, and stub shaft 166. The driven sprocket 161 is coupled to a sprocket 170 carried by the shaft of the backup roll structure 30 via a chain 172. The clutch 162 serves as a coupling between the input from the main machine drive and the fuser roll structure, which allows the fuser roll structure and backup roll to be rotated independently of the sprockets provided for power driving the fuser roll sturcture. In the event that a machine jam occurs, a sheet of copy paper which has started through the nip of the fuser assembly 15 can be manually moved out of the fuser assembly while simultaneously fusing the toner images to the copy paper. Accordingly, unlike prior art fuser structures utilized in the xerographic process, a copy which has started through the fuser but has not been completely fused can be saved because it can be fused notwithstanding a paper jam.

Figure 7:
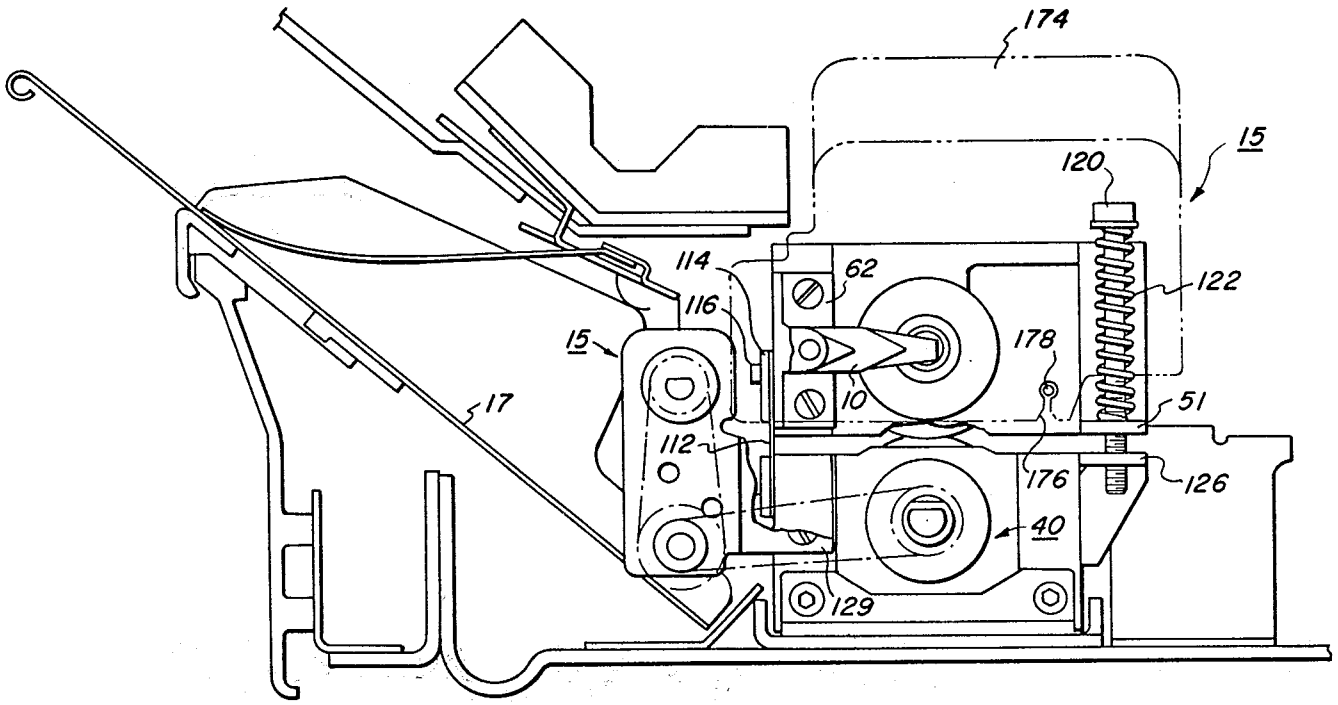
FIG. 7 is an elevational view of the fuser assembly as viewed from the left in FIG. 3.

A cover structure 174 protects the fuser assembly from contaminates. As viewed in FIG. 7, the cover structure has a bifurcated flange portion 176 which receives a pin member 178 carried by the bracket 50. There are two such flanges and pin members, one on each side of the fuser assembly. A sidewardly projecting flange 180 has an aperture through which a screw 181 is inserted and received in a threaded aperture in a flange 182 forming a part of the sump 68. The combination bifurcated flanges and pin members together with the screw 181 secures the cover in place. As viewed in FIG. 3, the cover has an inclined top surface 184 and an opening 186 at the extreme right end thereof for directing vapors out of the fuser assembly. A pair of depending flanges 190 cooperate with pins 192 carried by the tie bar 106 to assist in maintaining the cover in place.

While the invention has been described with respect to a preferred embodiment, it will be apparent that certain modifications and changes can be made without departing from the spirit and scope of the invention, for example, the images to be fused can be formed by other than the xerographic process disclosed and it is therefore intended that the foregoing disclosure be limited only by the claims appended hereto.

What is claimed is:

1. Contact fuser apparatus for fixing toner images to support sheets, said apparatus comprising:

a heated fuser member;

a resilient backup member;

means including a support base for supporting said members such that they cooperate to move support sheets therebetween with said toner images contacting said heated fuser member, said backup member being disposed adjacent said base;

means for cleaning toner from said backup member including a smooth surfaced member having a substantially planar portion positioned for contacting said backup member intermediate the ends of planar portion and forming a nip therebetween, the exit of said nip being disposed opposite said support base whereby toner particles accumulating at the exit of said nip fall upon said support base; said cleaning means comprising a triangular-shaped member and an angular support therefor wherein two sides of said triangular-shaped member are in intimate contact with the two sides of said angular support while said planar portion is unsupported thereby, said planar portion being the third side of said triangular member;

means for movably supporting said cleaning means; and means for biasing said cleaning means into its operative position in engagement with said backup roll, said biasing means comprising a spring contacting one side of said triangular member for urging the triangular member in a first direction and said bias means further comprising said backup member for urging said triangular member in a second direction substantially perpendicular to said first direction.

2. Apparatus according to claim 1 wherein the urging of said triangular member is said first direction effects engagement of said substantially planar portion with said backup member and said triangular shaped cleaning member is supported on rollers disposed between the other side of said triangular member and said support base.

3. Apparatus according to claim 2 wherein said heated fuser member comprises a fuser roll structure having an internal source of heat and said backup member comprises an elastomeric roll structure.

4. Apparatus according to claim 3 wherein said triangular-shaped member comprises a sleeve of tetrafluoroethylene which is shrunk fit onto said triangular support.

* * * * *